US008151989B2

(12) United States Patent
Appelabaum et al.

(10) Patent No.: US 8,151,989 B2
(45) Date of Patent: Apr. 10, 2012

(54) TRAPPED BLISTER PACKAGE WITH RECESSED CARD PERIMETER

(76) Inventors: Paul Appelabaum, Huntington Beach, CA (US); Gary Eddington, Jr., Westminster, CA (US)

( * ) Notice: Subject to any disclaimer, the term of this patent is extended or adjusted under 35 U.S.C. 154(b) by 0 days.

(21) Appl. No.: 12/806,509

(22) Filed: Aug. 16, 2010

(65) Prior Publication Data

US 2011/0079529 A1 Apr. 7, 2011

Related U.S. Application Data

(63) Continuation-in-part of application No. 12/587,217, filed on Oct. 5, 2009, now abandoned.

(51) Int. Cl.
*B65D 73/00* (2006.01)

(52) U.S. Cl. ..... 206/463

(58) Field of Classification Search ..... 206/461–464, 206/467, 471

See application file for complete search history.

(56) References Cited

U.S. PATENT DOCUMENTS

| | | | | |
|---|---|---|---|---|
| 3,399,763 | A * | 9/1968 | Stone | 206/462 |
| 3,721,339 | A * | 3/1973 | Seyer | 206/463 |
| 3,948,393 | A * | 4/1976 | Lewi | 206/462 |
| 4,124,953 | A * | 11/1978 | Patton | 206/462 |
| 2010/0193392 | A1 * | 8/2010 | Karow | 206/462 |

* cited by examiner

*Primary Examiner* — Bryon Gehman

(57) ABSTRACT

A trapped card package includes a paperboard card having a flat top surface and a flat bottom surface, and a relatively large central rectangular opening. In the top surface and the bottom surface respectively, there is a recessed portion that extends around the opening. A clear plastic blister piece has a groove extending along its perimeter and a flange, and a lower clear plastic piece has a male element extending along its perimeter, and a flange. The lower piece male element engages the card opening and its flange engages the recessed portion of the card bottom and the male element projects upward beyond the top surface of the card where it is received by the perimeter groove of the blister piece as the flange of the blister piece engages the recessed portion of the card top surface, so as to trap the card and seal the package when adhesive on the engaged element is cured. A variant has a plastic lower piece with a major central opening bounded by a flange, and a paper-based print card that engages this flange and covers this major opening.

13 Claims, 9 Drawing Sheets

TRAPPED BLISTER PACKAGE WITH RECESSED CARD PERIMETER

Continuation-in-Part of application Ser. No. 12/587,217 filed Oct. 5, 2009, now abandoned

BACKGROUND OF THE INVENTION

1. Field of the Invention

The present invention relates to card and clear plastic blister piece type packages for small articles of commerce, and more particularly to such a package where the card is embraced by the flanges of opposing plastic pieces.

2. Description of the Prior Art

Card and blister packages, trapped blister packages and other conventional packages having clear plastic blister pieces adhesively attached to paper-based cards are popular ways for packaging small articles of commerce. Unfortunately such packaging is often not easily "source separable", by the purchaser upon opening, in the sense of separating the majority of the paper component of a package from the plastic which is desirable ecologically for recycling purposes.

One inherent problem with said packages is that when the paper card is torn from the plastic, the separation is often not complete because of remnants of paper adhesively bonded to the plastic.

SUMMARY OF THE INVENTION

In view of the foregoing, it is a general object of the present invention to provide an environmentally friendly package that lends itself to efficient, easy and effective source separation, i.e. separation of paper source material from plastic, while also avoiding occurrences of residual adhesion of paper to plastic.

A related object is to provide a package having clear plastic components that secure a card component without adhesively bonding to it.

These and other objects and advantages are provided by a trapped card package according to the present invention that features a paperboard card, an upper clear plastic blister piece, and a lower clear plastic cover piece. The card has a major generally rectangular opening, and the blister piece has an article-receiving recess and a perimeter portion featuring a downwardly opening female element extending there-along, and a flange.

The lower, or cover piece has a perimeter portion that features a raised male element extending there-along, and a flange, which male element is adapted to engage the card opening and protrude above the top surface of the card when the package is assembled, with the flange engaging the bottom surface of the card. Then the female element of the blister piece can be pressed into engagement with the positioned male element, with the blister piece flange engaging the card top surface to cooperate with the bottom piece flange to "trap" the card there between, whereby the engaged elements can be adhesively bonded to seal the package.

In one variant of the invention the blister piece is hinged to the bottom or cover piece.

In another variant the bottom piece is the clear plastic blister piece with a male element for engaging the card opening, and a flange for engaging the card bottom surface. The upper component is in the form of a paperboard piece that is hingedly attached to an edge of the paperboard card, the hinged piece having a female perimeter element and an adjoining flange. The hinged piece is rotatable to bring its female element into engagement with the blister piece male element.

In yet another variant of the invention, one with enhanced anti-pilferage properties, the card top surface has a recessed peripheral portion about the opening, and the bottom surface of the card is similarly provided with a recessed portion about the card opening. In the assembled package the blister piece flange is adapted to engage the card top recessed portion and will lay flush with the card top surface, and the flange of the lower piece engages the card bottom recessed portion and lays flush with the card bottom surface.

In still another variant that advantageously provides reduced plastic content to the package, the plastic lower piece has a major central opening bounded by a flange, and there is a paper-based print card that engages this flange and covers the opening.

A further and more detailed description of the invention can be found by reading of the detailed description and claims which follow.

DETAILED DESCRIPTION OF THE INVENTION

Figure 1:
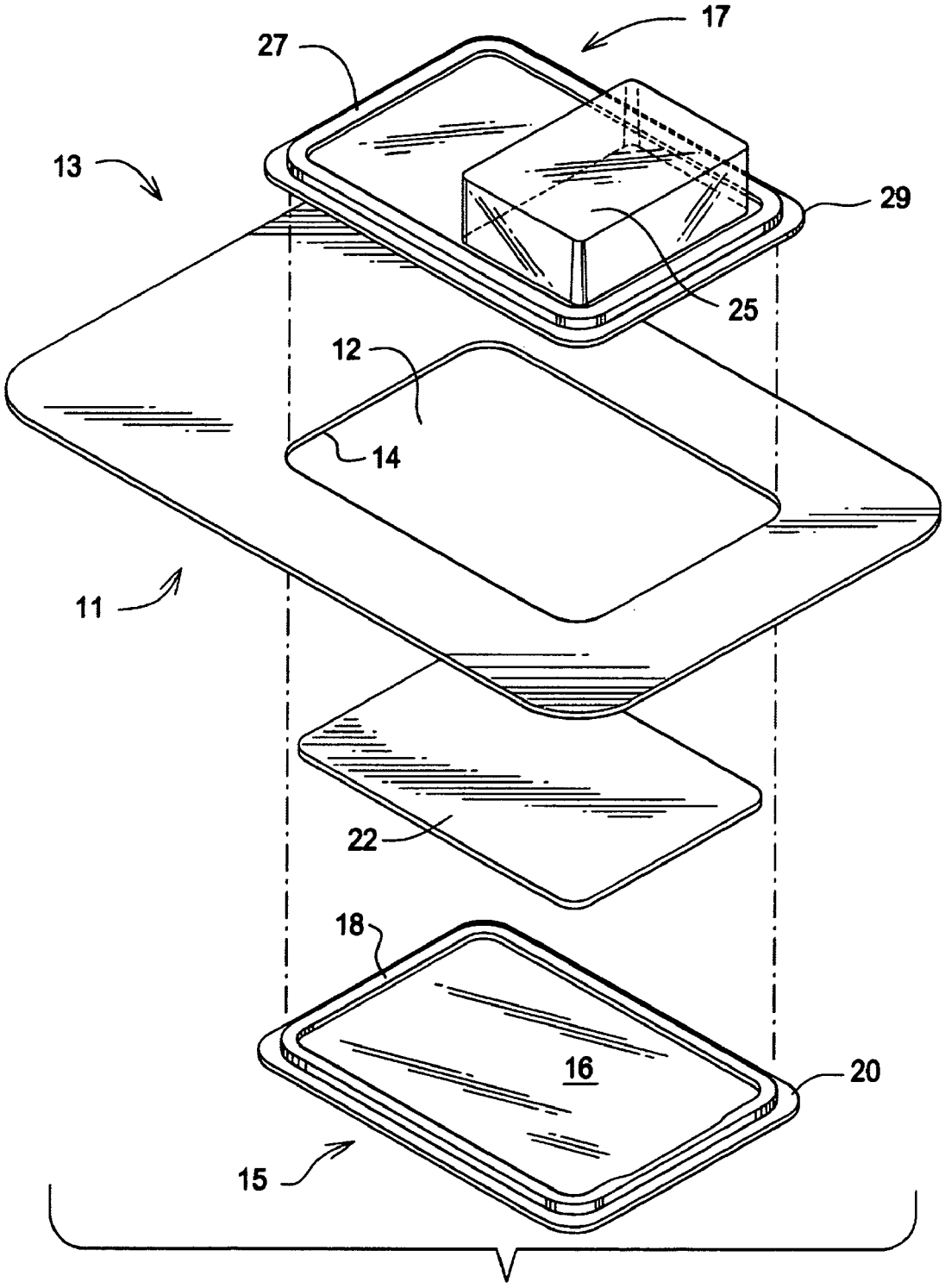
FIG. 1 is a perspective view of a preferred embodiment of a trapped card package according to the present invention.
Figure 2:
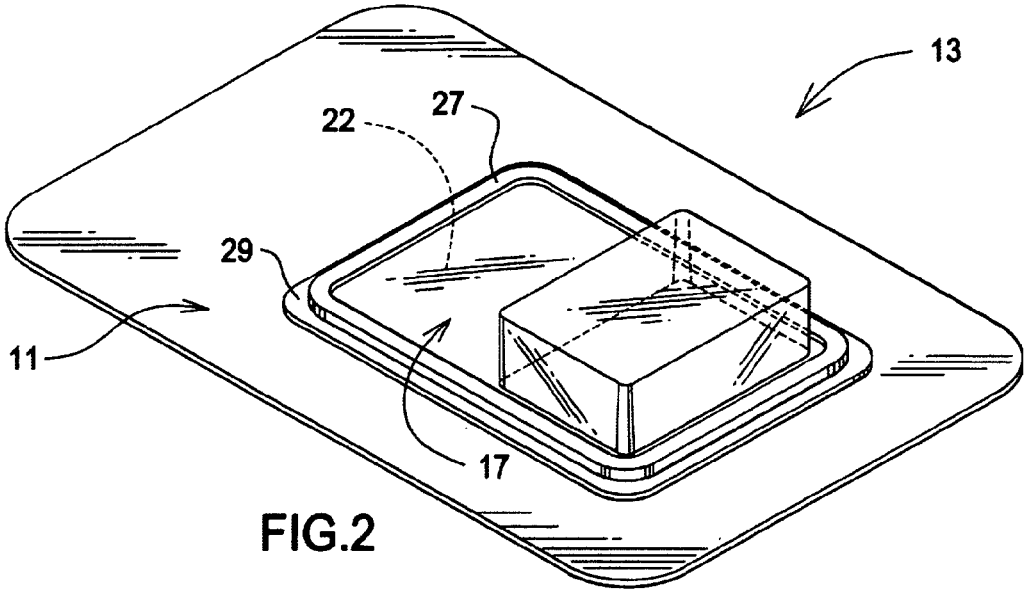
FIG. 2 is a perspective view of the package of FIG. 1 in closed configuration.
Figure 3:
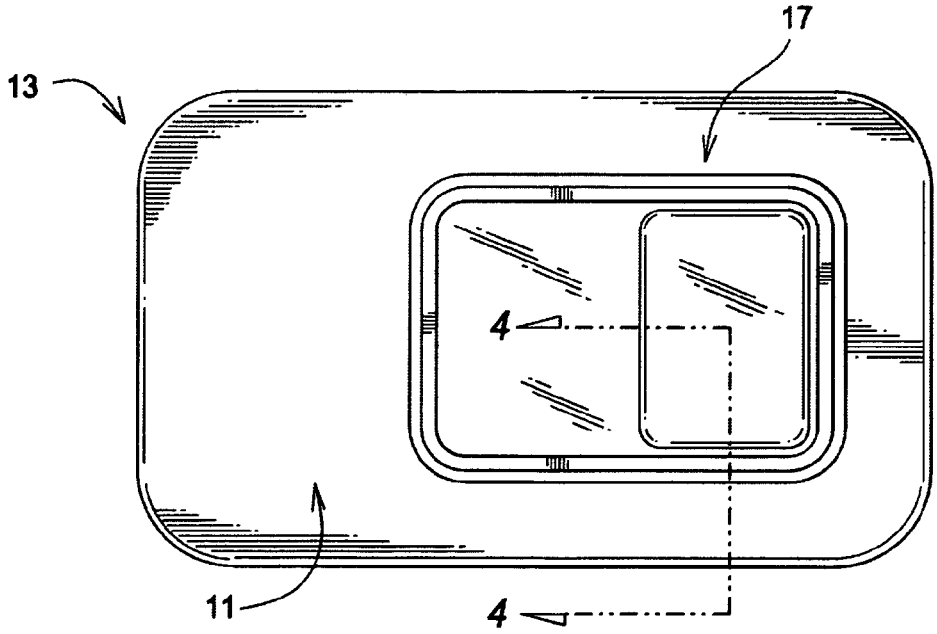
FIG. 3 is a top plan view of the package of FIG. 2.

Referring now to the drawings, FIG. 1 shows that a preferred embodiment of a trapped card package 13 according to the present invention includes a card 11, of corrugated paper board or other suitable cardboard, having a major opening 12 with edge 14. There is a lower clear plastic piece 15 having a major flat surface 16, a peripherally extending male upwardly projecting element 18 and a perimeter flange 20. A paper print card 22 is designed to engage the flat surface 16 of piece 15. Card 22 can contain graphic displays and various bits of product information. Finally, there is a clear plastic blister piece 17 that features a product-receiving blister 25, a peripherally extending, downwardly-opening female feature 27, and flange 29.

Figure 4:
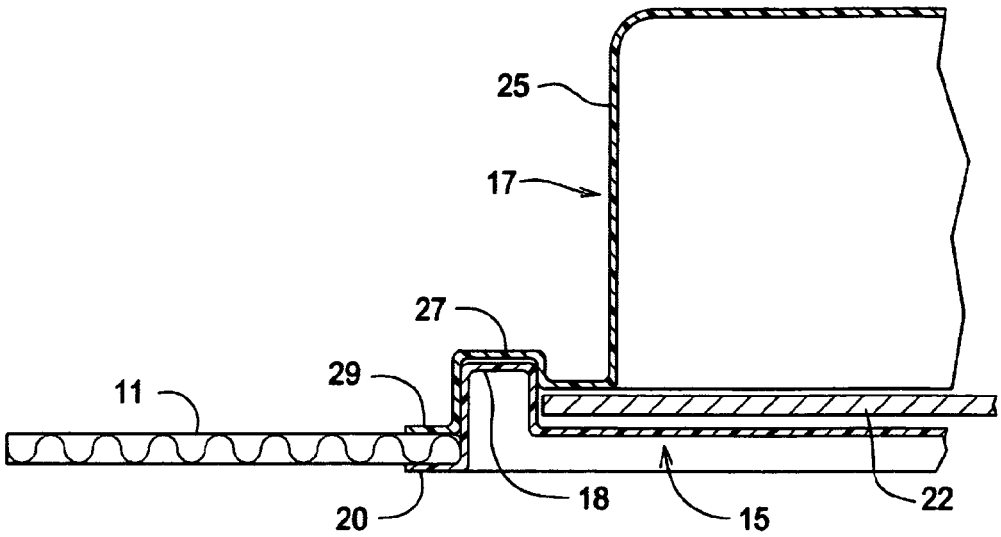
FIG. 4 is a sectional view taken along the line 4-4 of FIG. 3.

Further by reference to FIG. 1 it can be appreciated that the male connector element 18 of bottom piece 15 is designed to be snugly received in the card opening 12 and engagement with the edge 14 will provide lateral stability. Flange 20 will engage the bottom surface of card 11 and the upper part of the connector element 18 will project beyond the upper surface of card 11, as best shown in FIG. 4.

Figure 5:
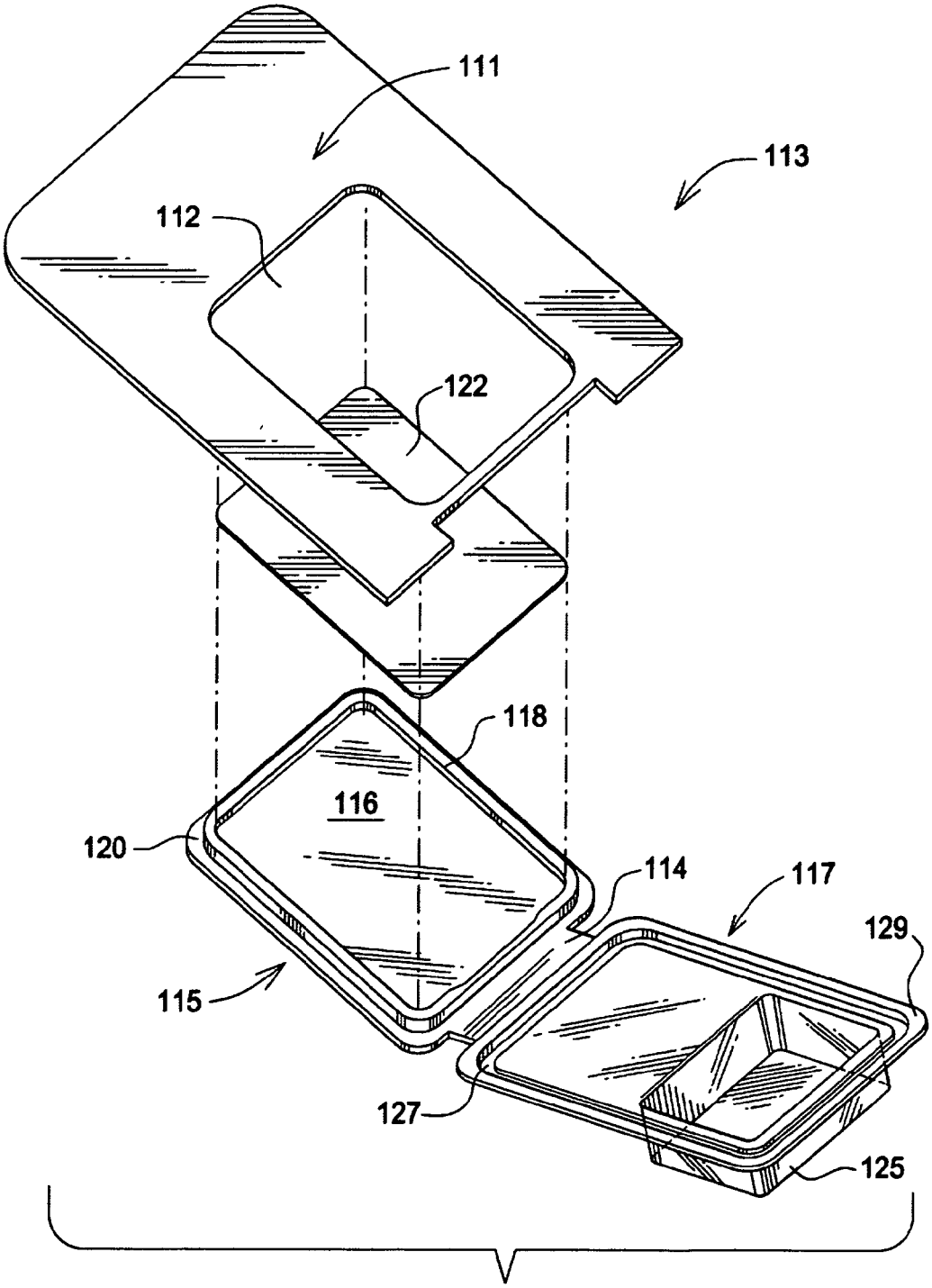
FIG. 5 is a perspective view of a hinged blister variant according to the present invention.

FIG. 5 shows a variant 113 of the present invention in which the blister piece 117 is attached to a lower clear piece 115 by hinge 114. Note that the blister piece 117 has product cavity 125, a female element or groove 127, and flange 129. The piece 115 includes flat surface 116, a flange 120 and male element 118 that is designed to engage the element 127. FIG. 5 also shows card 111, having opening 112.

The print card 122 is sized to be received on the surface 116 with its outer edges adjacent the element 118. With print card 122 in place, the element 118 can be engaged through card opening 112, to bring the flange 120 against the lower side of card 111. Then the blister piece 117 can be rotated up and over to bring its female element 127 into engagement with element 118, with flange 129 cooperating with the other flange to trap the card there-between.

Figure 6:
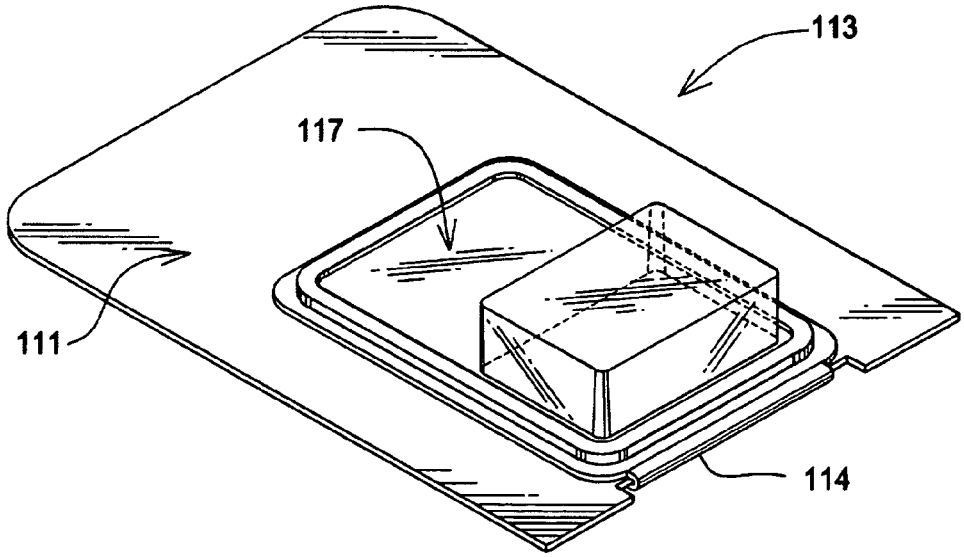
FIG. 6 is a top perspective view of the closed package of FIG. 5.

FIG. 6 shows the completed package 113.

Figure 7:
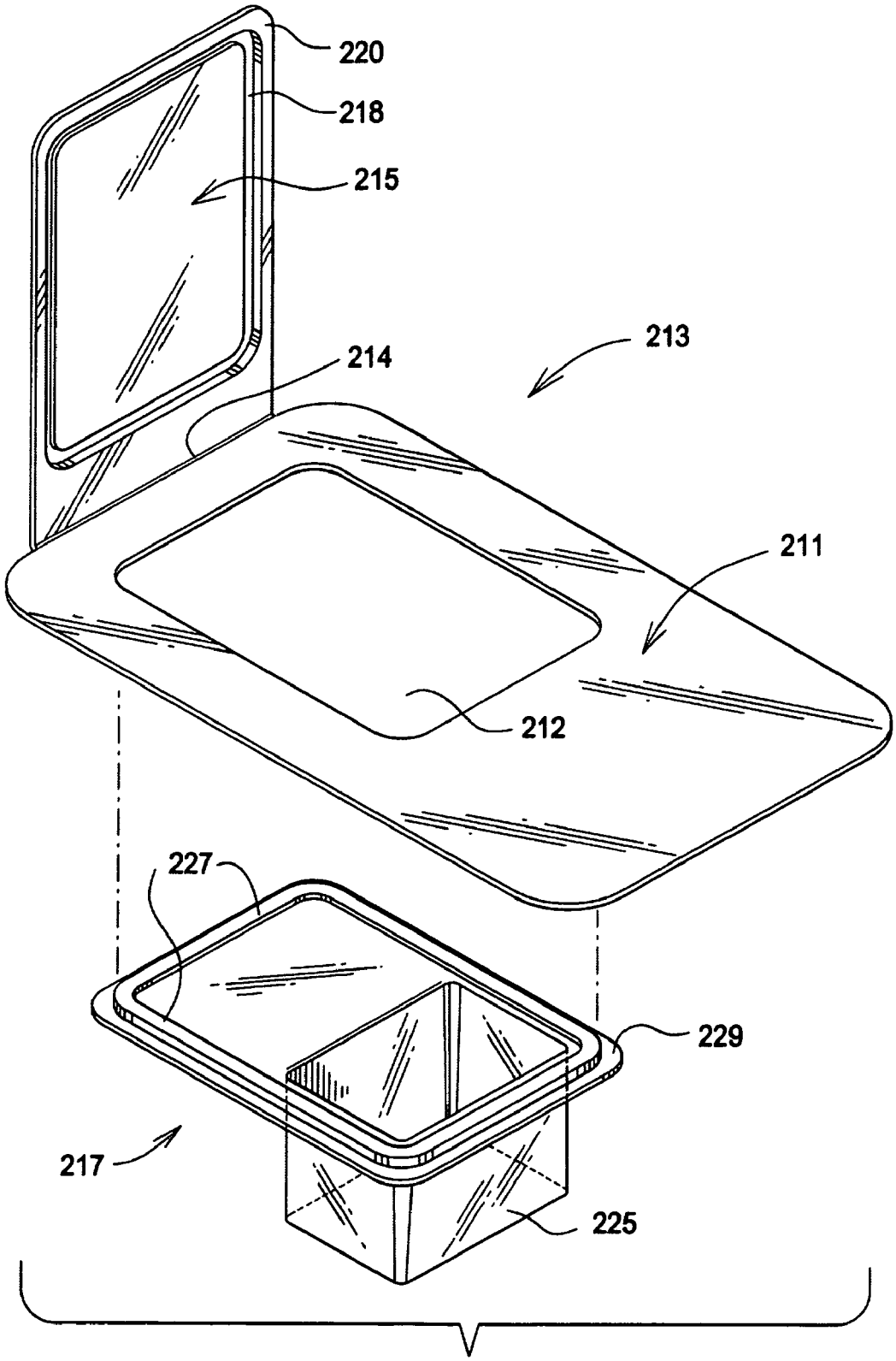
FIG. 7 is a perspective view of another variant of the present invention.
Figure 8:
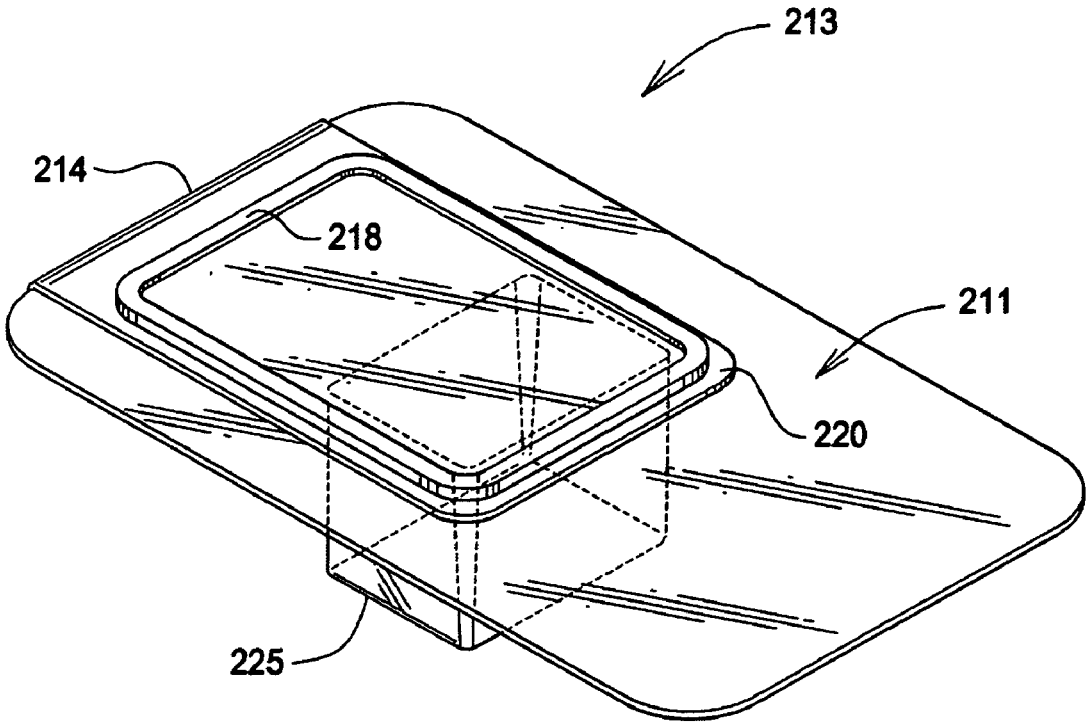
FIG. 8 is a perspective view of the closed package of FIG. 7.

FIG. 7 shows yet another variant according to the present invention in the form of package 213 that, like the foregoing example, has a card 211 with an opening 212 and features an additional card component 215 that is attached by hinge 214 to main card 211. Hinged card 215 has groove 218 and flange 220. The blister piece 217 includes product-receiving blister 225, and male connector element 227 and flange 229. It should be appreciated how, when the male element 227 is engaged through opening 212, the hinged piece 215 can be rotated to bring its groove into engagement with element 227, with opposing flanges trapping card 211.

Figure 9:
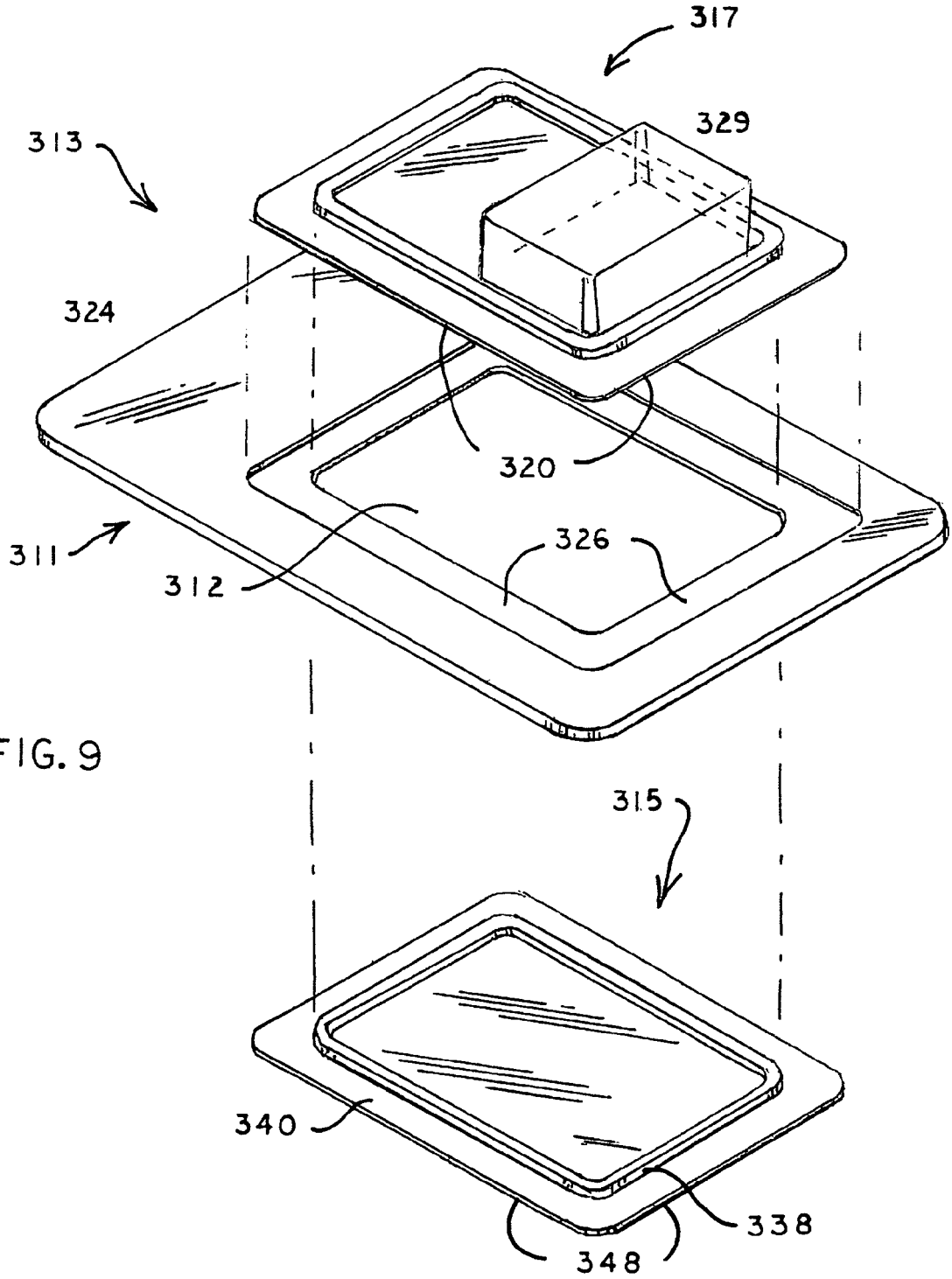
FIG. 9 is a perspective view of a variant of a package according to the invention.

Yet a further variant of the invention that, among other things, has enhanced anti-pilferage features, is shown in FIG. 9, in the form of package 313 that includes a blister piece 317 having flange 329 and flange edge 320.

Figure 11:
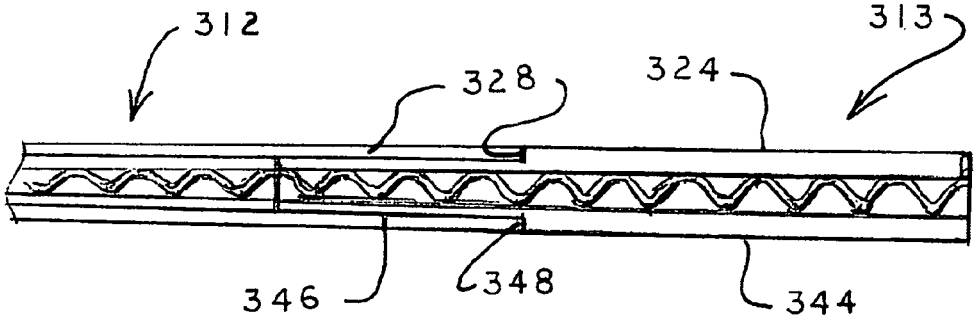
FIG. 11 is a sectional view, enlarged, taken along the line 11-11 of FIG. 9.

The card 311 is of corrugated core construction and has main opening 312 and a top surface 324 that features a flat recessed portion 326, about the opening 312, which forms a perimeter edge 328. The bottom surface of card 311 mirrors the top surface, and also has a sunken portion, and is shown in FIG. 11 where bottom surface 344 has recessed portion 346 and perimeter edge 348. The lower piece 315 has male element 338 and flange 340 having perimeter edge 340.

Figure 10:
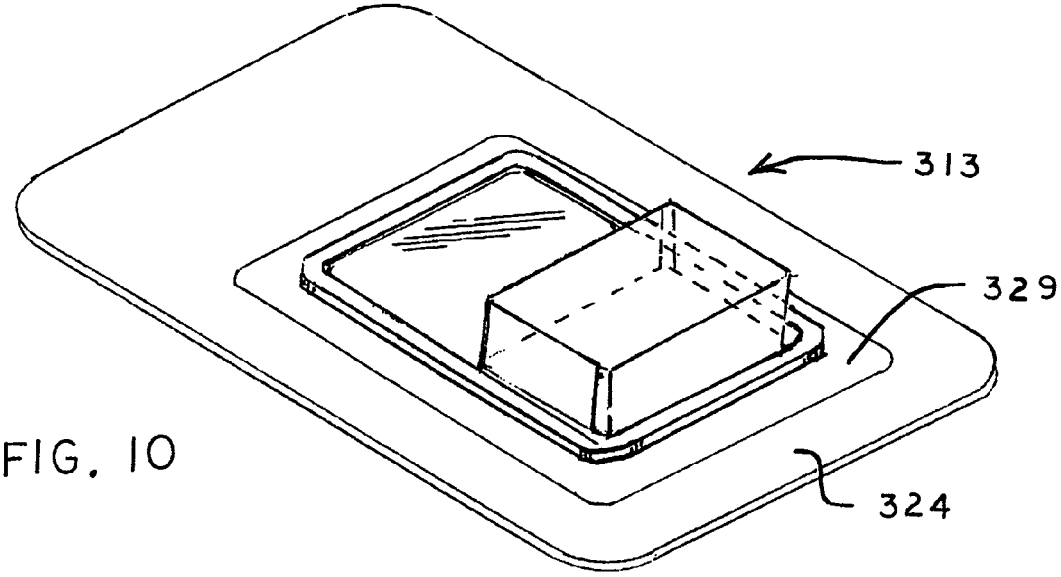
FIG. 10 is a top perspective showing the package of FIG. 9 in closed configuration.

When the package 313 is assembled the respective male and female connector elements of the blister piece 317 and the lower piece 315 engage in a way similar to that in the earlier described variants, and the blister flange 329 engages sunken portion 326 and the flange 315 of lower piece 315 engages the sunken portion in the bottom of the card, not shown. The depths of the recessed portion 326 and the thickness of blister flange 329 are selected such that in the closed package, shown in FIG. 10, the flange lays flush with the card, with the blister edge 320 fitting to the card edge 328, and the flange surface 329 level with the card top surface 324. It should be appreciated how the lower piece flange 340 will engage the card bottom and lay flush therewith.

Figure 12:
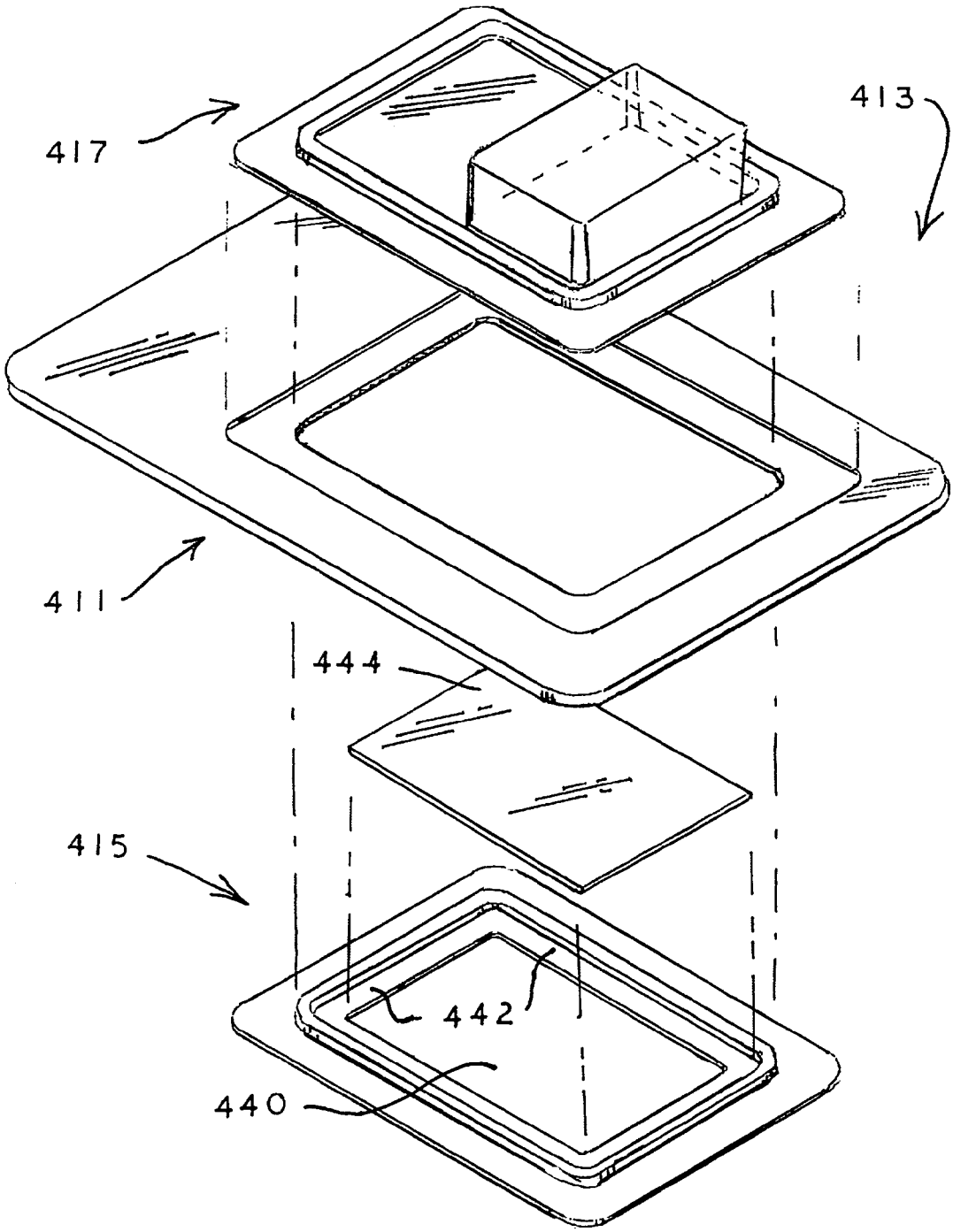
FIG. 12 is a perspective view of yet another variant of the invention.

Yet another variant of the invention that has significant reduction in plastic content, is shown in FIG. 12, where the package 413 has a blister piece 417 and a card 411 that have constructions like that of blister piece 317 and card 311 respectively, of the afore-described package 313. The lower piece 415 is similar to the piece 315 except for major opening 440 and inner flange 442. Finally, there is a paper-based print card 444 that is designed to engage flange 442 and cover the opening 440. It should be appreciated how in the assembled package 413, the print card 444 will be sandwiched between the blister piece 417 and the bottom piece 415.

While a particular embodiment of the invention has been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

The invention claimed is:

1. A trapped blister package for small articles of commerce including:

a) a generally rectangular paperboard card having a major opening, and a flat top surface and a flat bottom surface, said top surface having a recessed peripheral portion extending around said opening, with a perimeter edge, and said bottom surface having a recessed portion about said opening and a perimeter edge;

b) a clear plastic blister piece including an article-receiving recess and a perimeter portion having a first connector element extending along said perimeter portion, and a flat flange having a top surface and a perimeter edge;

c) a cover piece having a perimeter portion that includes a second connector element that extends along said perimeter portion, and a flat flange having a bottom surface and a perimeter edge; wherein d) said package has a closed configuration in which said cover piece covers said card opening and said cover piece flange engages said recessed portion in the bottom surface of said card with said flange perimeter edge engaging said recessed perimeter edge, and the flange of said blister piece engages said recessed portion in the top surface of said card with said flange perimeter edge engaging said recessed perimeter edge, and said first element engages said second element, whereby said blister flange lays flush with said card top surface, and said cover piece flange lays flush with said card bottom surface, and whereby said engaged elements can be adhesively bonded to secure said closed package.

2. A package as defined in claim 1 wherein said first connector element is a female element comprising a groove, and said second connector element is a male element that protrudes beyond said card top surface and is adapted to engage said female element.

3. A package as defined in claim 2 wherein said opening has an edge and said male element is adapted to engage said opening edge to hold said card against lateral movement.

4. A package as defined in claim 2 wherein said cover piece is of clear plastic.

5. A package as defined in claim 2 wherein said cover piece is of the same material as said card, and is hingedly attached to an edge of said card.

6. A package as defined in claim 2 wherein said blister piece, and said cover piece are generally rectangular.

7. A package as defined in claim 6 wherein said blister piece is hinged to said cover piece.

8. A package as defined in claim 1 wherein said cover piece is of clear plastic.

9. A package as defined in claim 1 wherein said blister piece is hinged to said cover piece.

10. A package as defined in claim 1 including an insert card adapted to be received in said card opening.

11. A package as defined in claim 1 wherein said cover piece is of the same material as said card, and is hingedly attached to an edge of said card.

12. A package as defined in claim 1 wherein said first connector element, on said blister piece, is a male element that protrudes beyond said card bottom surface, and said second connector element is a female element comprising a groove, and adapted for engaging said male element.

13. A package as defined in claim 1 wherein said cover piece and said blister piece are of clear plastic and said cover piece has a major central opening bounded by an inner flange, and including a flat paper-based print card that engages said inner flange and covers said central opening.

* * * * *